US005989130A

United States Patent [19]

Macaluso

[11] Patent Number: 5,989,130

[45] Date of Patent: Nov. 23, 1999

[54] MULTI-USE NET

[76] Inventor: Anthony G. Macaluso, 7101 Circa de Media, Escondido, Calif. 92029

[21] Appl. No.: 09/013,396

[22] Filed: Jan. 26, 1998

[51] Int. Cl.[6] ..... A63B 63/00

[52] U.S. Cl. ..... 473/197; 273/400; 273/407; 473/476

[58] Field of Search ..... 473/197, 454, 473/476; 273/395, 400, 407

[56] References Cited

U.S. PATENT DOCUMENTS

| | | | |
|---|---|---|---|
| 5,088,740 | 2/1992 | Peterson | 273/410 |
| 5,244,213 | 9/1993 | Armell | 273/400 |
| 5,269,527 | 12/1993 | Noval | 273/181 F |
| 5,427,381 | 6/1995 | Macaluso et al. | 273/400 |
| 5,433,433 | 7/1995 | Armell | 273/26 |
| 5,569,094 | 10/1996 | Macaluso | 473/197 |

*Primary Examiner*—Mark S. Graham
*Attorney, Agent, or Firm*—Lynn & Lynn

[57] ABSTRACT

A portable net has an erected configuration for stopping the flight of a golf ball and returning it to a selected location and a folded configuration for storage or transport. The portable net has an elastic frame formed of a single elastic member that forms a base and a net support section. A net is connected to the net support section of the frame so that the net extends away from the base in the erected configuration. The frame is configured such that a person may put the frame into a folded configuration by deforming the first and second frame members into a plurality of generally concentric rings. A retainer such as a strap is provided for selectively retaining the frame in the folded configuration. The frame is formed such that elastic forces in the frame spontaneously move the frame to the erected configuration when the retainer is not engaged to retain the frame in the storage configuration.

10 Claims, 4 Drawing Sheets

MULTI-USE NET

BACKGROUND OF THE INVENTION

This invention relates generally to apparatus and methods that allow a person to practice hitting or throwing a ball or the like in a confined space without having the ball travel a large distance or hit other persons or objects and cause injury or damage.

SUMMARY OF THE INVENTION

The multi-use net according to the invention has several advantages over the prior art. The invention catches the ball without requiring anchors to keep in the desired location. The multi-use according to the invention net requires no assembly, is self-standing, easily collapsible for storage or transit and can be used indoors or outdoors.

A self-erecting portable net according to the present invention that has an erected configuration for stopping the flight of a projectile and a folded configuration for storage or transport, comprises an elastic frame formed of a single elastic member formed to include an upper frame member and a base. The base has a front base portion and a rear base portion, and the base and upper frame portion cooperate to hold the portable net in a generally upright orientation on a generally horizontal surface when the portable net is in its erected configuration. The upper frame portion and the front and rear base portions preferably are formed of a single flexible member such as a wire.

A first fabric section is connected to the upper frame portion, and the upper frame portion is arranged so that when the portable net is in its erected configuration, the upper frame portion extends upward away from the base. The first fabric section is arranged to stop the flight of a projectile that is incident thereon.

The frame is configured such that it may be placed into the folded position by deforming the upper frame portion and the base into a plurality of generally concentric rings. The invention further includes a retainer for selectively retaining the frame in the folded configuration, the frame being formed such that elastic forces in the frame spontaneously move the frame to the erected configuration when the retainer is not engaged to retain the frame in the storage configuration.

The self erecting portable net according to the present invention may also further comprise a pair of flexible cross straps connected between the upper frame member and the rear base portion with the pair of cross straps being arranged to maintain a selected angular spacing between the upper frame portion and the rear base portion.

The self erecting portable net may further comprising a fabric webbing connected between a portion of the base and the second frame member. A second fabric section may be connected to the front base portion.

An appreciation of the objectives of the present invention and a more complete understanding of its structure and method of operation may be had by studying the following description of the preferred embodiment and by referring to the accompanying drawings.

DESCRIPTION OF THE PREFERRED EMBODIMENT

Figure 1:
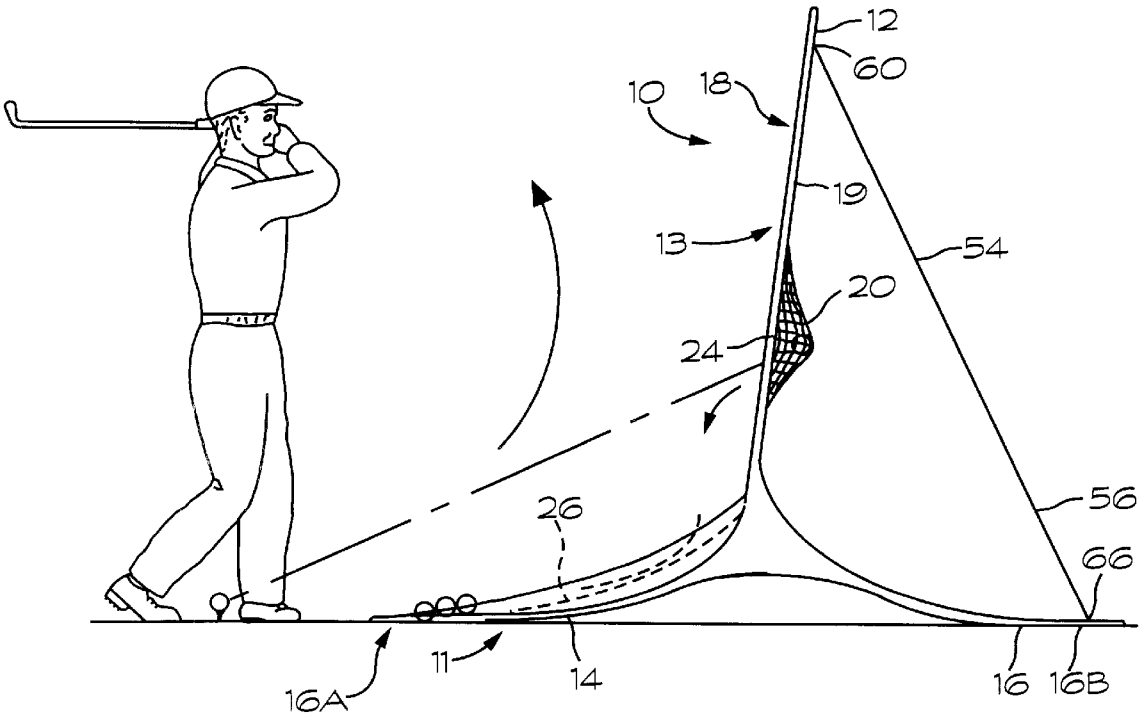
FIG. 1 illustrates a side of multi-use net according to the invention and shows a golf ball that has been stricken with a golf club being incident upon the net.

Referring to FIG. 1, a multi-use net 10 comprises a frame 12 that comprises a single member preferably comprised of wire, fiberglass or a composite material. The frame member has ends that are connected together by a connector 12A, shown in FIG. 3.

The frame 12 is arranged to include an upper frame portion 13 and a base 16. The base 16 includes a front base portion 16A and a rear base portion 16B.

A fabric 18 is connected to the frame 12 by one or more suitable sleeves 19 or a plurality of loops. A fabric band 40 may extend from the side of the fabric 18 near the lower portion of the upper frame section 13. The fabric 18 includes a first fabric section 20 that is arranged to receive a ball or other similar projectile. The fabric section 20 preferably is formed of netting or the like and is arranged to absorb the impact of the ball, which may be moving at speeds of up to 150 mph or greater. The fabric section 20 absorbs the impact the ball so that it has no appreciable recoil velocity.

Figure 2:
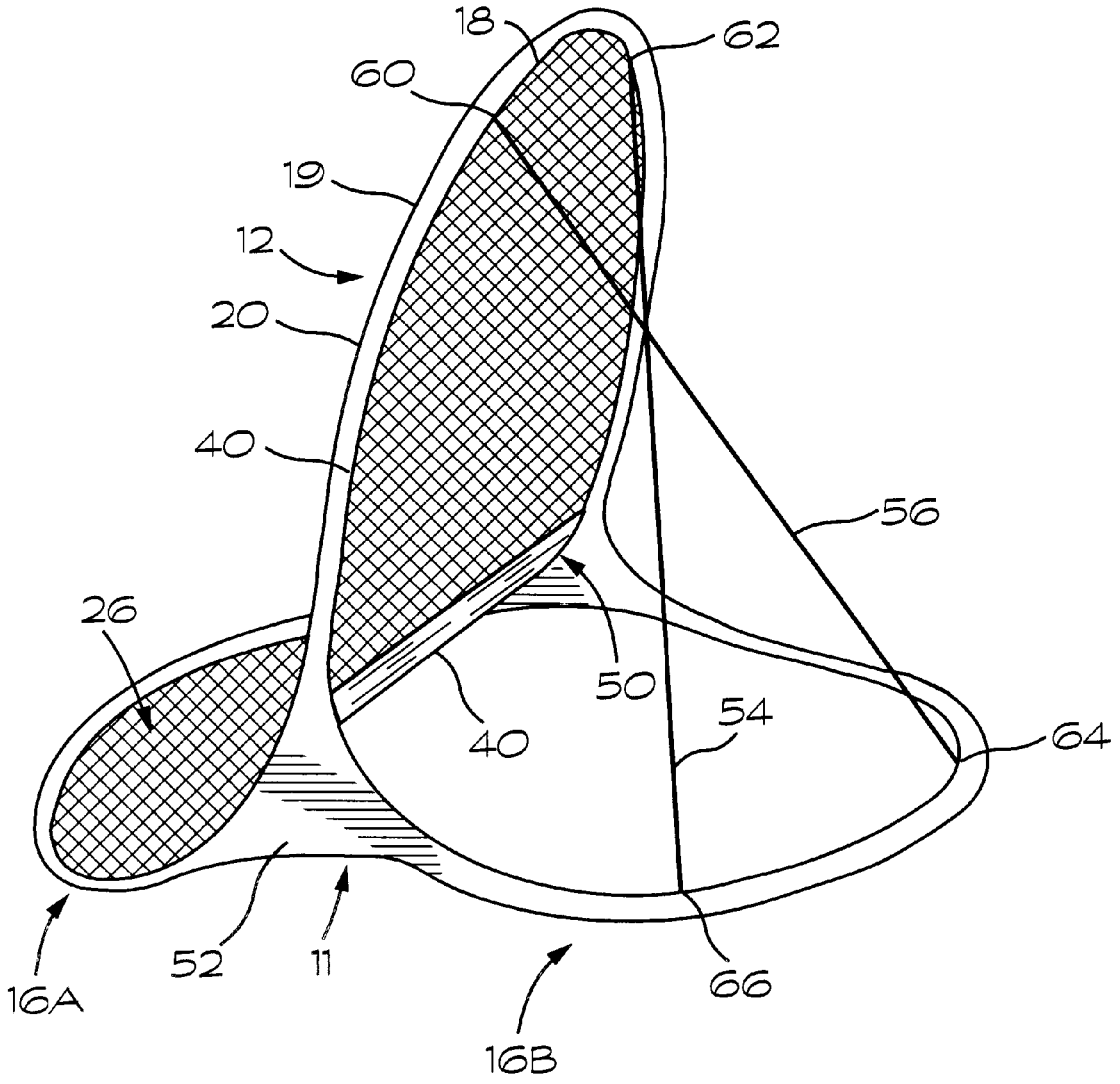
FIG. 2 is a perspective view of a multi-use net according to the present invention.
Figure 3:
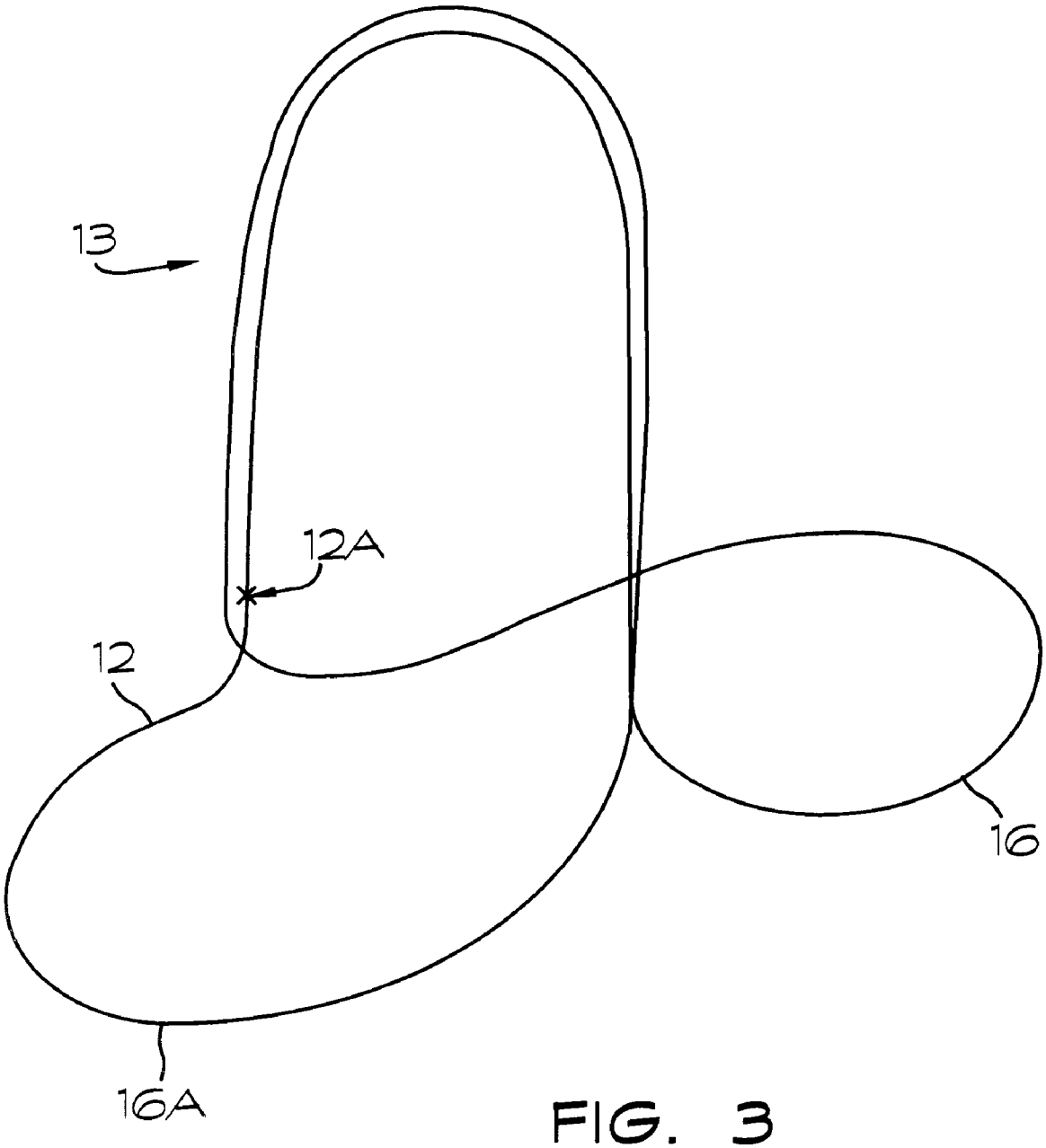
FIG. 3 is a perspective view of a wire frame arrangement that may be included in the apparatus of FIGS. 2 and 3.

The frame 12 is formed from a flexible material that has a memory for the erected configuration of FIGS. 1–3. Steel spring wire, fiberglass or a composite of various materials may be used to form a suitable frame 12. The ends of the frame 12 preferably are connected together by any convenient fastening means 12A so that the frame 12 forms a continuous loop that includes both the upper portion 13 and the base portions 14 and 16. The upper frame portion 13 preferably is substantially upright when it is in the erected position of FIGS. 1–3.

The upper fabric section 20 preferably is formed generally either as a half oval or a semicircle. The band 40 separates the upper fabric section 20 and a lower fabric section 26 that is attached to the front base portion 16A. The lower fabric section 26 also preferably is formed generally either as a half oval or a semicircle. The sleeve 19 preferably has a pair of generally triangular fabric webbing sections 50 and 52 that extend between the front base portion 16A and the rear base portion 16B.

Referring to FIGS. 1 and 3, the multi-use net 10 preferably includes a pair of straps 54 and 56 that extend from upper portions 60 and 62 on the sleeve 19 to locations 64 and 66 on the fabric band 19 near the rear edge of the rear base portion base 16B. The straps 54 and 56 preferably cross one another to make a generally "X" configuration. The straps 54 and 56 may be formed of heavy twine, rope, wire, etc.

Figure 4:
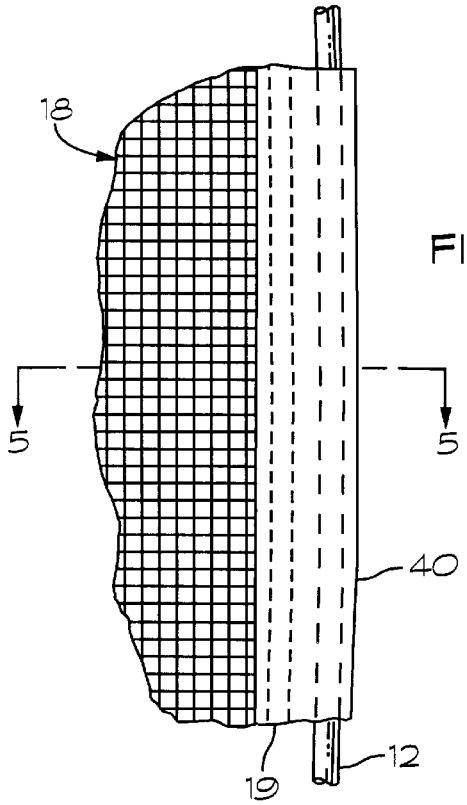
FIGS. 4 and 5 illustrate attachment of a portion of the net to the frame.
Figure 5:
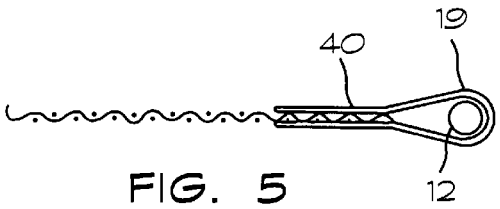

FIGS. 4 and 5 illustrate means for attaching the fabric 18 to the sleeve 19 that surrounds the frame 12. Stitching 70 may be used to retain the fabric 18 securely connected to the sleeve 19.

The multi-use net 10 may be folded for storage as shown in FIGS. 6A–6E. Because of the memory of the frame 12 for the erected configuration, unless it is constrained, the spring forces in the frame 12 will cause the multi-use net 10 to spontaneously assume the erected configuration. Therefore, the multi-use net is self-erecting if the frame 12 is not constrained to some other configuration.

Figure 6D:
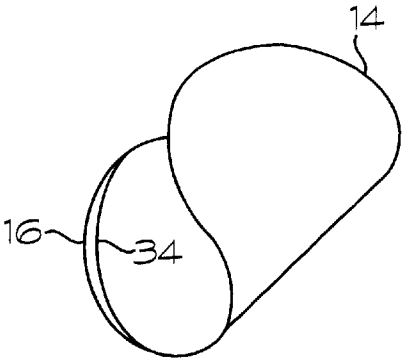
FIGS. 6A–6F. illustrate steps involved in folding the multi-use net according to the invention for storage.
Figure 6C:
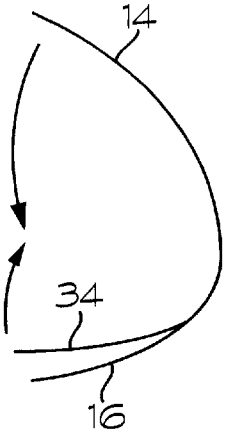
Figure 6B:
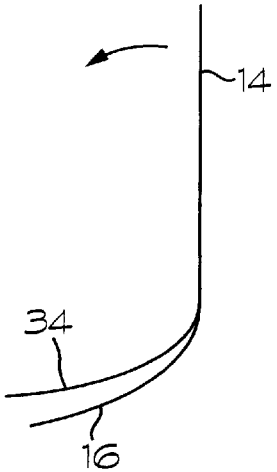
Figure 6A:
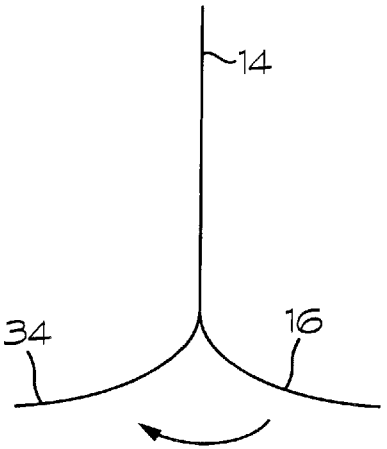
Figure 6F:
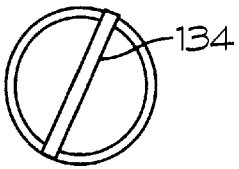
Figure 6E:
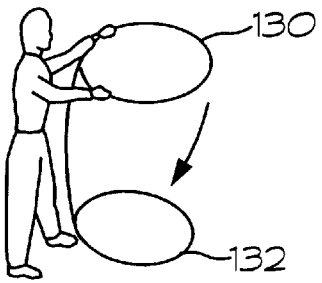

Referring to FIG. 6A, the first step in folding the multi-use net 10 for storage is to pull the rear base portion 16 front base portion 16B toward the front base portion 16B so that they are substantially adjacent. Referring to FIGS. 6B and 6C, the upper portion 32 of the upper portion 14 of the frame 12 is then pulled downward so that it bends about its central portion, which is near the straight portion of the base 16. Referring to FIG. 6D, after the ends of the base portions 16A and 16B and the upper edges of the upper frame member 14 are pulled close together, the sides of the frame 12 are pulled together so that the multi-use net 10 is shaped generally as a "taco shell." Referring to FIG. 6E, the folding process continues by twisting the frame members 14 and 16 to form a pair of loops 130 and 132, which may be then held close together and secured by a strap 134 or the like as shown in FIG. 6F. The frame 12 then is coiled up in a compact configuration suitable for storage or transport.

The structures and methods disclosed herein illustrate the principles of the present invention. The invention may be embodied in other specific forms without departing from its spirit or essential characteristics. The described embodiments are to be considered in all respects as exemplary and illustrative rather than restrictive. Therefore, the appended claims rather than the foregoing description define the scope of the invention. All modifications to the embodiments described herein that come within the meaning and range of equivalence of the claims are embraced within the scope of the invention.

The foregoing detailed description is to be clearly understood as given by way of illustration and example only, the spirit and scope of this invention being limited solely by the appended claims.

What is claimed is:

1. A self-erecting portable net that has an erected configuration for stopping the flight of a projectile and a folded configuration for storage or transport, comprising:

an elastic frame formed of a single elastic wire formed to include an upper frame member and a base, the base having a front base loop and a rear base loop, the base and upper frame portion cooperating to hold the portable net in a generally upright orientation on a generally horizontal surface when the portable net is in its erected configuration a first fabric section connected to the upper frame portion, the upper frame portion being arranged so that when the portable net is in its erected configuration, the upper frame portion extends upward away from the base;

the frame being configured such that the frame may be placed into the folded position by deforming the upper frame portion and the base into a plurality of generally concentric rings; and a retainer for selectively retaining the frame in the folded configuration, the frame being formed such that elastic forces in the frame spontaneously move the frame to the erected configuration when the retainer is not engaged to retain the frame in the storage configuration.

2. The self erecting portable net of claim 1, further comprising a pair of flexible cross straps connected between the upper frame member and the rear base loop, the pair of cross straps being arranged to maintain a selected angular spacing between the upper frame portion and the rear base loop.

3. The self erecting portable net of claim 1, further comprising:

a fabric band having a portion connected between opposite sides of the frame.

4. The self erecting portable net of claim 3 comprising retainer means formed as a sleeve in the fabric band, with the frame passing through the sleeve to form the upper frame member, the front base loop and the second base loop.

5. The self erecting portable net of claim 4, further comprising a fabric webbing connected between the front base loop and the rear base loop.

6. The self erecting portable net of claim 3, further comprising a second fabric section connected to the front base loop.

7. A method for forming a self-erecting portable net that has an erected configuration for stopping the flight of a projectile and a folded configuration for storage or transport, comprising:

forming an elastic frame of a single elastic wire arranged to include an upper frame member and a base, the base having a front base loop and a rear base loop, the base and upper frame portion cooperating to hold the portable net in a generally upright orientation on a generally horizontal surface when the portable net is in its erected configuration connecting a first fabric section to the upper frame portion;

arranging the upper frame portion so that when the portable net is in its erected configuration, the upper frame portion extends upward away from the base;

arranging the first fabric section to stop a projectile that is incident thereon;

configuring the frame such that it may be placed into a plurality of generally concentric rings; and providing a retainer for selectively retaining the frame in the folded configuration, the frame being formed such that elastic forces in the frame spontaneously move the frame to the erected configuration when the retainer is not engaged to retain the frame in the storage configuration.

8. The method of claim 7, further comprising the steps of connecting a pair of flexible cross straps between the upper frame and the rear base loop and arranging the pair of cross straps to maintain a selected angular spacing between the upper frame portion and the rear base loop.

9. The method of claim 7, further comprising the steps of:

connecting a fabric band having a portion between the first fabric portion and the second fabric portion;

forming a sleeve in the fabric band; and arranging a portion of the upper frame member to fit within the sleeve.

10. The method of claim 9, further comprising the step of connecting a fabric webbing between a portion of the base and the upper frame member.

* * * * *